United States Patent [19]

Herrmann

[11] Patent Number: 4,599,882

[45] Date of Patent: Jul. 15, 1986

[54] DEVICE FOR BENDING THE MARGINS OF A METAL FOIL OVER THE EDGE OF A FLAT GLASS ARTICLE

[76] Inventor: Heinz Herrmann, Leipziger Str. 105, D-4154 Tönisvorst 1, Fed. Rep. of Germany

[21] Appl. No.: 673,542

[22] Filed: Nov. 20, 1984

[30] Foreign Application Priority Data

Dec. 17, 1983 [DE] Fed. Rep. of Germany ... 8336280[U]

[51] Int. Cl.[4] ..... B21D 17/10

[52] U.S. Cl. ..... 72/211; 72/479; 29/243.58

[58] Field of Search ..... 72/199, 211, 214, 215, 72/470, 479, 379, 411, 458, 459; 29/243.5, 243.58, 278, 283.5, 509

[56] References Cited

U.S. PATENT DOCUMENTS

| | | | |
|---|---|---|---|
| 3,478,558 | 11/1969 | Hoffman et al. | 72/470 |
| 3,541,836 | 11/1970 | Meis | 72/479 |
| 4,233,863 | 11/1980 | Cooper et al. | 29/243.58 |

*Primary Examiner*—Francis S. Husar
*Assistant Examiner*—Robert Showalter
*Attorney, Agent, or Firm*—Karl F. Ross; Herbert Dubno

[57] ABSTRACT

A tool for applying the margins of a metal foil strip which is adhesively bonded to the edge of a glass article onto the broad surfaces of the article comprises a handle having a pair of elongated arms merging into the handle and extending therefrom to straddle the edge of the article. The flanks have guide surfaces inclined to the longitudinal dimension of the tool to ride upon the edge of the article and surfaces which press the marginal portion of the strip onto the broad surfaces of the glass.

11 Claims, 7 Drawing Figures

DEVICE FOR BENDING THE MARGINS OF A METAL FOIL OVER THE EDGE OF A FLAT GLASS ARTICLE

FIELD OF THE INVENTION

My present invention relates to a device for bending of the margins of a metal foil strip onto the broad surfaces of a flat glass article to which the strip has been applied as a preliminary to soldering the article in place in the production of leaded glass or stained glass products.

BACKGROUND OF THE INVENTION

In the production of leaded glass and stained glass objects, one conventional technique of securing the pieces of flat glass, generally of different colors and/or textures, in contiguous relationship, is to apply to the edge of each flat glass segment, a metal foil strip, generally a copper foil strip which is adhesive-backed and is pressed with its adhesive backing against the edge of the flat glass article so that margins of the strip project on opposite sides of the edge and are then pressed on to the broad surfaces of the glass article adjoining the edge.

The final strip is generally extracted from a roll and may have a masking strip or protective strip adhered to the adhesive and which must be removed before the adhesive backing is applied to the glass article.

After the foil has been smoothed onto the edge of the flat glass article and the margins have been flattened against the broad surfaces of the article adjoining the edge, the foil forms, in effect, a channel embracing the edge portion of the glass article and secured thereto by the adhesive layer.

When the foil-sheathed edge of one glass section is placed adjacent the foil-sheathed edge of another glass section, after the application of an appropriate flux, solder can be deposited on the foil channels to ultimately cut the margins and be drawn by capillarity between the foils so that a solder-coated channel is thereby formed. The latter retains the glass sections in place in the finished "leaded" glass article.

In my copending application Ser. No. 670,531, filed Nov. 13, 1984, I have described a device for stripping the paper-masking layer from the pressure-sensitive adhesive of the foil and "rolling" the foil onto the edge of the glass article so that the margins of the foil strip will project beyond the edge and can be then bent over the broad faces of the glass article. In earlier manual techniques and with the use of this device, the bending of the foil margin was effected by the fingers in a stripwise manner which sometimes caused wrinkling, folding or crimping of the foil, exposed the worker to sharp edges and caused contamination of the foil by natural body oils and the like.

OBJECTS OF THE INVENTION

It is the principal object of the present invention to provide a device which will allow the foil margins to be applied conveniently and uniformly to the broad surfaces of the glass article at the edge to which the foil has been adhesively applied.

Another object of this invention is to provide a device which can be easily manipulated and handled and which is capable of rapidly ensuring the bending of the margins of a metal foil onto the surfaces of a glass sheet.

SUMMARY OF THE INVENTION

These objects and others which will become apparent hereinafter are attained, in accordance with the present invention, in a device which comprises a handle and a pair of substantially parallel flanks connected to this handle and positioned to press the respective margins of a foil strip, previously applied to the edge of a flat glass article, onto the broad surfaces of the glass without requiring a contact of the fingers of the user with the foil strip and therefore possible transfer of oils and other contaminants to the strip which might interfere with soldering and also without requiring the fingers of the user to come into contact with the sharp edges of the glass article.

It suffices that the two flanks of the device are drawn along the edge of the glass article and overlie or flank these edge portions of the broad surfaces to smooth the margins of the foil strip onto the latter and press the margins thereagainst to ensure a secure bonding of the adhesive layer to the glass.

In a preferred embodiment of the invention, the flanks merge and are flush with the grip, i.e. are formed in one piece therewith and are separated by a slot through which the edge of the glass article is passed.

Best results are obtained when the flanks are formed with inwardly turned projecting guide shoulders for the edge of the article, the guide shoulders preferably extending over the entire height of the margin-deflecting flanks.

The guide shoulders can be inclined at the longitudinal axes or dimensions of the flanks, preferably at an angle of about 45°, this angle facilitating drying the tool around the edge of a glass article to which the foil strip has been applied so that the margins can be bent over the broad surfaces of the article.

In another embodiment of this invention, in the region of the free ends of the flanks, mutually juxtaposed rollers can be provided whose peripheries lie inwardly from the flanks into the slot between them. The rollers, which apply the margins to the broad surfaces of the glass article, preferably have their axes inclined in an angle to the longitudinal dimension of the flanks. The rollers provide the advantage that a sliding friction against the foil strip is avoided so that extremely thin metal foils with a minimum of tear resistance can be used. The roller axes can be orthogonal to the guide shoulders so that the rollers in a substantially frictionless movement can roll over the edge of the glass article.

The cheeks can be resiliently biased toward one another, e.g. by cantilevering them on resilient material integral with the handle and thus can accommodate different thicknesses of the glass articles. When only a given glass article thickness will be used, however, the flanks can be fixed.

Preferably, the tool is molded in one piece from a synthetic resin material although it may also be molded from synthetic resin material and provided with rollers of metal or the same or another synthetic resin material.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
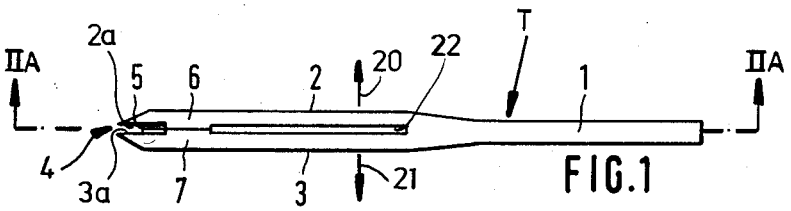
FIG. 1 is a plan view of a tool for applying the margins of a foil strip to the broad surfaces adjacent the edge of a glass article according to the invention.
Figure 2:
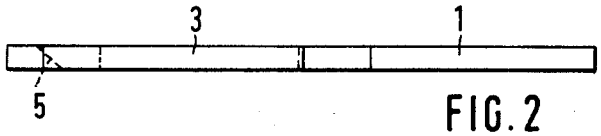
FIG. 2 is a side-elevational view thereof.
Figure 2A:
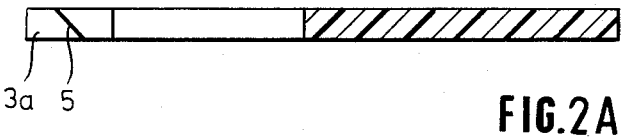
FIG. 2A is a cross-sectional view taken along the line IIA—IIA of FIG. 1.

In the embodiment of FIGS. 1, 2 and 2A, the grip 1 is formed integrally and merges into or is flush with a pair of mutually parallel flanks 2 and 3 formed as arms cantilevered on the grip and thus having a certain resiliency against outward deflection as well as a certain yieldability as represented by the arrows 20, 21 to allow the device to accommodate various thicknesses of glass articles. The flanks 2 and 3 are here shown to be separated by a slit 22. The free ends of these flanks define a slot 4 constituting a mouth into which the glass article can be inserted.

The mouth is delimited by inwardly projecting guide shoulders 5 which form an angle of about 45° with the longitudinal dimension of the tool.

The shoulders 5 are formed at the ends of inward projections 6 & 7 by which the flanks 2 and 3 are braced against one another to determine the minimum width of the slot 4. Thicker glass articles will deflect the flanks away from one another.

Figure 3:
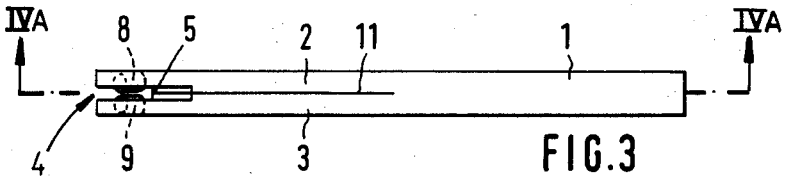
FIG. 3 is an elevational view illustrating another embodiment of the invention.
Figure 4:
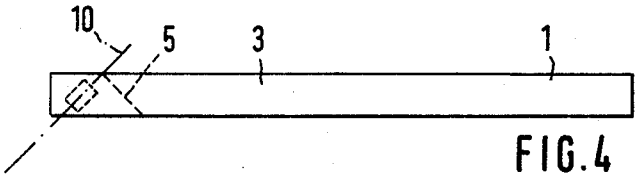
FIG. 4 is a side-elevational view of this embodiment.
Figure 5:
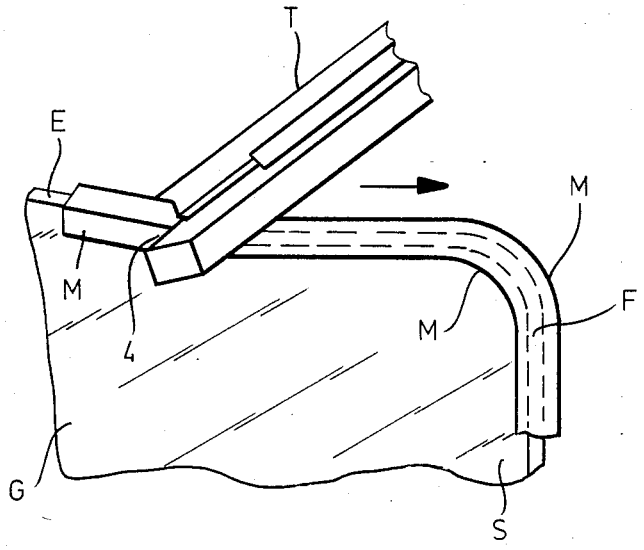
FIG. 5 is an elevational view illustrating the use of the tool of FIGS. 1, 2 and 2A according to the invention.

In FIG. 5, I have shown the use of the tool T in FIGS. 1, 2 and 2A. From this figure it can be seen that the tool is placed over the edge of the article so that the shoulders 5 ride along the edge of the article while the surfaces 2*a* and 3*a* press the margins M of the foil strip F into the broad surfaces S of the glass pane G. In the embodiment of FIGS. 3 and 4, where similar reference numerals have been used to indicate similarly functioning elements, each of the flanks 2 and 3 has a respective roller 8, 9 journaled therein so that only a portion 8*a*, for example, (see FIG. 4A) projects beyond the flank so that the rollers then roll along the margin M substantially perpendicular to the edge E of the pane.

Figure 4A:
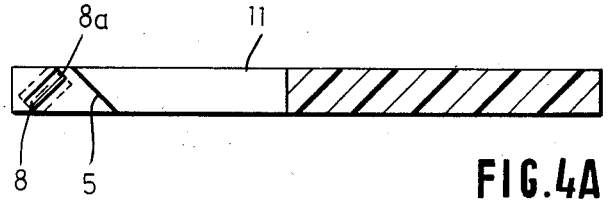
FIG. 4A is a section taken along the line IVA—IVA of FIG. 3.

The roller axes 10 are substantially orthogonal to the guide shoulders 5, as can be seen from FIGS. 4 and 4A. In this embodiment, the two flanks are subdivided by a slit 11 but can bear against one another over their full length and can be resiliently deflected outwardly from one another as described in connection with FIGS. 1 and 2.

I claim:

1. A device for bending the margins of a foil strip adhesively secured to an edge of a flat glass article onto broad surfaces of said article adjacent said edge, said device comprising a handle and a pair of parallel flanks extending from said handle and adapted to straddle said edge, said flanks being positioned to press said margins against said surface, said flanks having inwardly projecting shoulders lying intermediate said flanks forming guide surfaces for riding on said edge, said guide surfaces extending the entire height of said flanks and inclined to a longitudinal dimension of said flanks.

2. The device defined in claim 1 wherein said flanks merge into said handle.

3. The device defined in claim 1 wherein said guide surfaces are inclined at an angle of about 45° to the longitudinal dimensions of said flanks.

4. The device defined in claim 1 wherein each of said flanks is provided with a respective roller whose roller axis is inclined to the longitudinal dimension of said flanks.

5. The device defined in claim 1 wherein each of said flanks is provided with a respective roller whose roller axis is inclined to the longitudinal dimension of said flanks.

6. The device defined in claim 5 wherein the axes of said rollers are orthogonal to said guide surfaces.

7. The device defined in claim 1 wherein said flanks are resiliently deflectable apart.

8. The device defined in claim 3 wherein said flanks are resiliently deflectable apart.

9. The device defined in claim 5 wherein said flanks are resiliently deflectable apart.

10. The device defined in claim 1 wherein said flanks are fixed relative to one another.

11. The device defined in claim 1 wherein said flanks are formed with projections braced against one another.

* * * * *